US006189938B1

(12) United States Patent
Nakadaira et al.

(10) Patent No.: US 6,189,938 B1
(45) **Date of Patent: *Feb. 20, 2001**

(54) LOCKING STRUCTURE FOR COVERING ELEMENT

(75) Inventors: Fumio Nakadaira, Kawasaki; Mitsuaki Kumagai, Inagi; Takao Obata, Inagi; Toshiyuki Kobayashi, Inagi, all of (JP)

(73) Assignees: Fujitsu Limited, Kanagawa; Fujitsu Kiden LTD, Inagi, both of (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/151,356

(22) Filed: Sep. 10, 1998

(30) Foreign Application Priority Data

Sep. 30, 1997 (JP) ..... 9-267110

(51) Int. Cl.[7] ..... E05C 19/06
(52) U.S. Cl. ..... 292/87; 292/80
(58) Field of Search ..... 292/80, DIG. 38, 292/153, 152, 304, 202, 209, 118, 120, 116, 83, 99, 198, 200, DIG. 11, 87; 220/833, 326, 4.02; 429/96

(56) References Cited

U.S. PATENT DOCUMENTS 1,726,718 * 9/1929 Rice ..... 292/80
2,054,907 * 9/1936 Mollet ..... 292/126
3,466,076 * 9/1969 Bisbing ..... 292/DIG. 49
3,490,805 * 1/1970 Di Pierro et al. ..... 292/113
4,270,668 * 6/1981 Barfield ..... 292/87
4,363,403 * 12/1982 Raucci, Jr. et al. ..... 206/387
4,627,650 * 12/1986 Hauschulte ..... 292/113
4,917,420 * 4/1990 Rogers, Jr. ..... 292/198
4,986,438 * 1/1991 Borst ..... 220/315
5,033,778 * 7/1991 Niles et al. ..... 292/66
5,127,684 * 7/1992 Klotz et al. ..... 292/113
5,139,294 * 8/1992 Ward et al. ..... 292/246
5,206,098 * 4/1993 Cho et al. ..... 429/96
5,217,263 * 6/1993 Peterson ..... 292/112
5,270,011 * 12/1993 Altherr ..... 422/102
5,825,288 * 10/1998 Wojdan ..... 340/542

* cited by examiner

*Primary Examiner*—Teri Pham Luu

(57) ABSTRACT

A locking structure for releasably locking a covering element in a closed position on a unit housing. The locking structure includes a resiliently engaging member integrally formed on the covering element, and a supporting member pivotably connected to the covering element. The resiliently engaging member includes a pair of resilient first supports projecting from the covering element, a bar connecting the respective free ends of the resilient first supports with each other and a pair of projections formed on the bar to be releasably engaged with the housing. The supporting member includes a base plate pivotably connected to the covering element and a second support extending from the base plate to be releasably engaged with the resiliently engaging member. In a locked position of the locking structure, the bar is stably supported by the second support so that the projections are kept in engagement with the housing.

14 Claims, 7 Drawing Sheets

LOCKING STRUCTURE FOR COVERING ELEMENT

BACKGROUND OF THE INVENTION

1. Field of the Invention

The present invention relates generally to a device including mutually movable housing portions and locking means for locking the housing portions to each other. More particularly, the present invention relates to a structure for releasably locking a covering element in a closed position on a housing. The present invention may be considered as a structure for locking a covering element attached to a housing of a portable electrical unit, such as a hand-held terminal unit, a portable telephone, a video camera, a notebook-size personal computer, and so forth, to selectively open and close an opening defined in the housing.

2. Description of the Related Art

Various locking structures have been known in the art, which can releasably lock a covering element or lid in a closed position for closing an opening, such as an opening of a battery receptacle, a memory-card receptacle, and so on, defined in a housing of a portable electrical unit, such as a hand-held terminal unit, a portable telephone, a video camera, a notebook-size personal computer, and so forth. For example, it is known to provide a resilient hook, made of resin, along an edge portion of the covering element. The resilient hook can be engaged in a snap-fit manner with an inner shoulder formed along a peripheral edge of the opening defined in the housing when the covering element is attached to close the opening, and thus can lock the covering element in a closed position.

Another conventional locking structure is known as a shiftable member rotatably or slidably supported on the covering element to be able to move between locked and unlocked positions. The shiftable member is normally provided at one end thereof with a knob accessibly arranged outside the covering element, and at the other end thereof with an engagement piece disposed inside the covering element. The engagement piece can be engaged with an inner shoulder formed along a peripheral edge of the opening defined in the housing when the covering element is located to close the opening and the shiftable member is shifted into the locked position, and thus can lock the covering element in a closed position.

The above-mentioned conventional locking structures for the covering elements have several problems, as follows. Since the stability and reliability of the locking function of the resilient-hook locking structure depend only on the resilient property of the hook, the resilient-hook locking structure is relatively easily released or disengaged from the peripheral-edge inner shoulder of the opening when the covering element and/or the housing is subjected to vibration or shock.

Also, the shiftable-member locking structure increases the number of parts, and generally makes it difficult to reduce the size and/or weight of the portable electrical unit. Further, in the shiftable-member locking structure, the operation for shifting the shiftable member is usually troublesome. Moreover, since the shiftable member cannot be fully shifted into the locked position until the covering element is completely located in the closed position, it is necessary to confirm that the shiftable member has certainly or correctly locked the covering element in the closed position, to eliminate inadvertently opening or half-opening the covering element.

SUMMARY OF THE INVENTION

It is therefore an object of the present invention to provide a locking structure, for a covering element, which can improve the stability and reliability of the locking function of the locking structure, even when the covering element is subjected to a significant vibration or shock.

Another object of the present invention is to provide a locking structure for a covering element, which can certainly lock the covering element in a closed position by a relatively easy operation of the locking structure.

A further object of the present invention is to provide a locking structure which can readily eliminate inadvertently opening or half-opening the covering element.

An yet further object of the invention is to provide a device including such a locking structure.

In accordance with the present invention, there is provided a locking structure for releasably locking a covering element in a closed position on a unit housing, comprising a resiliently engaging member integrally formed on the covering element for releasable engagement with the unit housing; and a supporting member pivotably connected to the covering element for releasable engagement with the resiliently engaging member, the resiliently engaging member being stably supported by the supporting member in a locked position of the locking structure.

In the preferred aspect of the invention, the resiliently engaging member includes at least one resilient first support projecting from the covering element and at least one projection formed on a free end of the resilient first support to be releasably engaged with the unit housing.

In this arrangement, the resiliently engaging member may include a pair of resilient first supports projecting from the covering element, a bar connecting respective free ends of the resilient first supports with each other and a pair of projections formed on the bar to be releasably engaged with the unit housing.

In another preferred aspect of the invention, the supporting member includes a base plate pivotably connected to the covering element and a second support extending from the base plate to be releasably engaged with the resiliently engaging member.

In this arrangement, the second support may be formed as a flat plate extending from the base plate, and at least one catch may be provided at a free end of the flat plate, the base plate being held in the locked position by an interengagement between the catch and the resiliently engaging member.

Also, in this arrangement, the second support may be formed as at least one rib extending from the base plate, and a slanted edge may be provided at a free end of the rib, the base plate being held in the locked position by an interengagement between the slanted edge and the resiliently engaging member.

In a further preferred aspect of the invention, the supporting member is arranged to force the resiliently engaging member into a fixed engagement with the unit housing.

Advantageously, the locking structure further comprises a switching mechanism for detecting the closed position of the covering element, the switching mechanism being actuated by the supporting member when the supporting member is pivoted on the covering element.

The present invention also provides a device comprising a housing including a first portion and a second portion, the first portion being movable relative to the second portion; an engaging member provided on the first portion for releasable engagement with the second portion; and a supporting member pivotably provided in the housing for supporting the engaging member in engagement with the second portion, to lock the first portion to the second portion.

It is preferred that the supporting member is provided on the second portion.

It is also preferred that the second portion includes a recess for the releasable engagement with the engaging member.

In this arrangement, the supporting member may be arranged to force the engaging member into a fixed engagement with the recess.

BRIEF DESCRIPTION OF THE DRAWINGS

The above and other objects, features, and advantages of the present invention will become more apparent from the following description of preferred embodiments in connection with the accompanying drawings in which.

DESCRIPTION OF THE PREFERRED EMBODIMENT

Figure 1A:
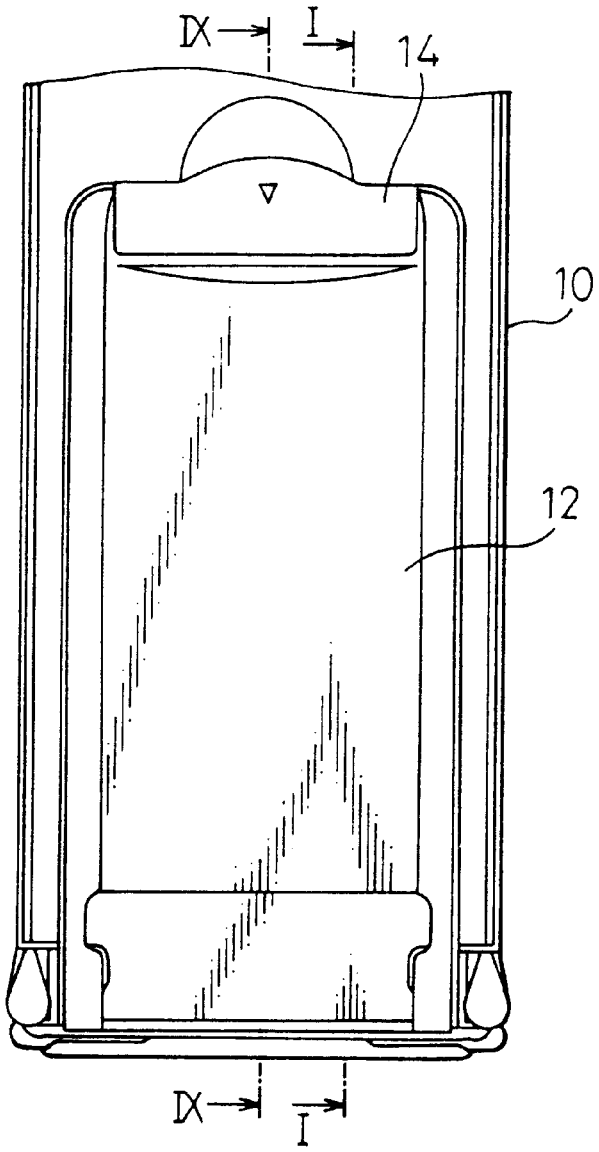
FIG. 1A is a front view of a covering element located in a closed position on a unit housing, showing a first embodiment of a locking structure, located in a locked position, according to the present invention.

Referring now to the drawings, in which the same or similar components are denoted by the same reference numerals, FIGS. 1A through 3C show a first embodiment of a locking structure according to the present invention. The locking structure of the first embodiment is used for releasably locking a covering element or lid in a closed position for closing an opening, such as an opening of a battery receptacle, a memory-card receptacle, and so on, defined in a housing of a portable electrical unit, such as a hand-held terminal unit, a portable telephone, a video camera, a notebook-size personal computer, and so forth. However, it will be appreciated that the present invention is also useful in the other applications.

Figure 1B:
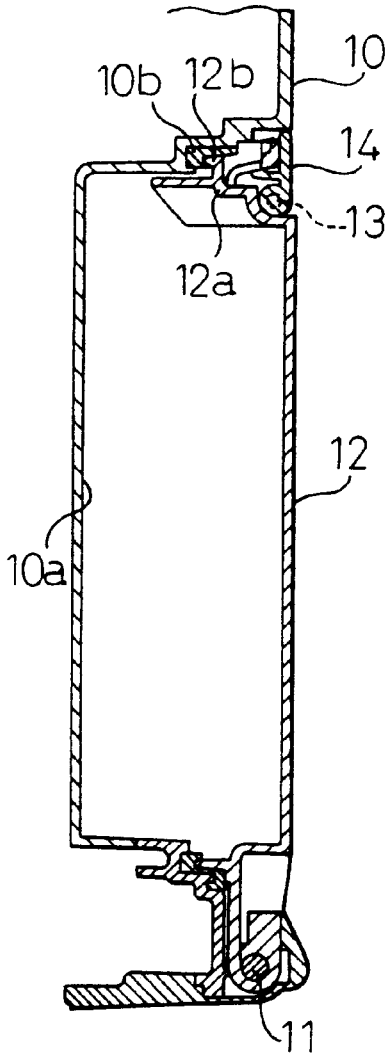
FIG. 1B is a sectional view taken along a line I—I in FIG. 1A.
Figure 2A:
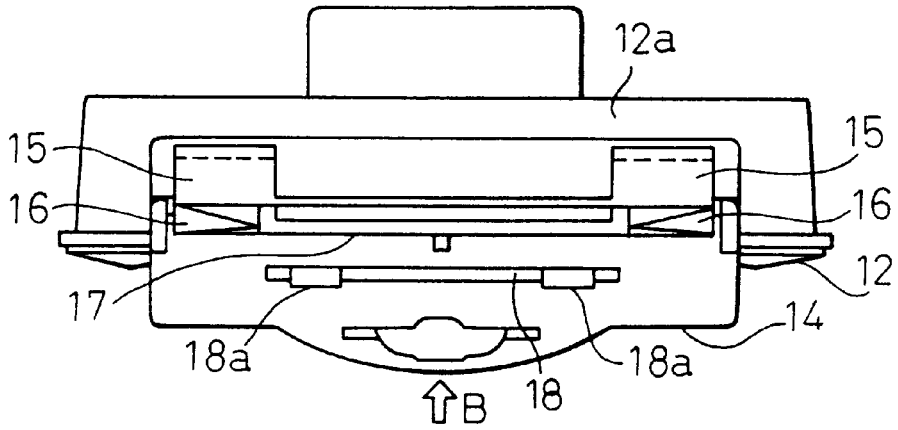
FIG. 2A is a top plan view of the covering element of FIG. 1A, showing the locking structure in an unlocked position.
Figure 2B:
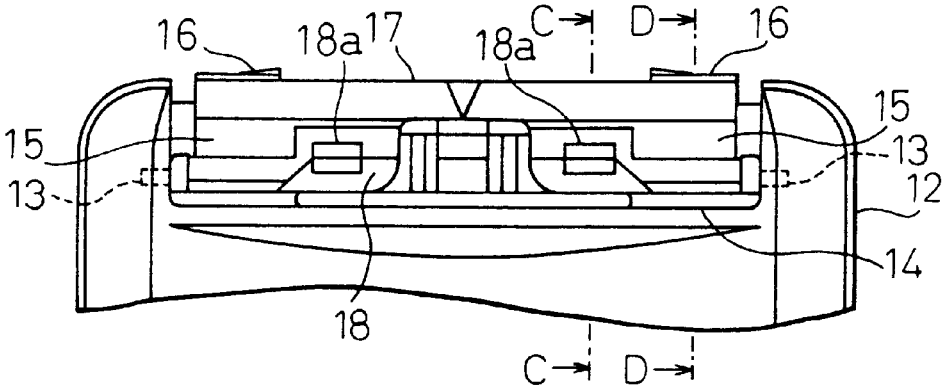
FIG. 2B is a front view of the locking structure in the unlocked position, and of a part of the covering element, as seen from an arrow B in FIG. 2A.
Figure 2C:
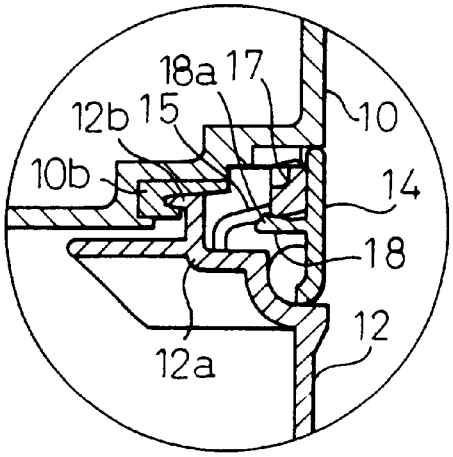
FIG. 2C is a sectional view of the locking structure in the locked position, and of a part of the covering element located in the closed position on the unit housing, as taken along a line C—C in FIG. 2B.
Figure 2D:
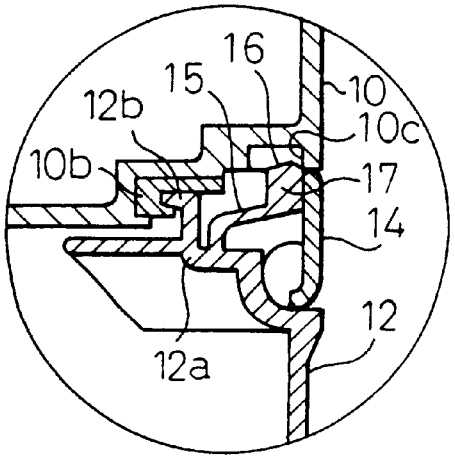
FIG. 2D is a sectional view of the locking structure in the locked position, and of a part of the covering element located in the closed position on the unit housing, as taken along a line D—D in FIG. 2B.

As shown in FIGS. 1A and 1B, a unit housing 10 of a portable electrical unit includes a receptacle 10*a* which defines an opening in the outer face of the housing 10. A covering element 12, or a first portion of the housing, is hingedly connected at the bottom end thereof to the housing 10 by a shaft 11, to selectively open and close the opening of the receptacle 10*a*. The covering element 12 is provided at the top end thereof with an extension 12*a* adapted to extend into the receptacle 10*a* when the covering element 12 is in a closed position shown in FIGS. 1A, 1B.

The extension 12*a* includes an edge 12*b* adapted to be detachably engaged with a shoulder 10*b* formed on an upper area of a housing wall defining the receptacle 10*a* (the upper area may be considered as a second portion of the housing). The shoulder 10*b* may be formed by a sealing member which can seal between the covering element 12 and the housing 10 in the closed position of the covering element 12.

The locking structure of the first embodiment is provided adjacent to the extension 12*a* of the covering element 12, and includes a base plate 14 pivotably or hingedly connected at the bottom end thereof to the covering element 12 by pins 13. As shown in FIGS. 2A to 2D, the locking structure of the first embodiment further includes a pair of resilient first supports 15 curvedly projecting upward and frontward (rightward in FIG. 2C) from the extension 12*a* of the covering element 12.

The resilient first supports 15 are spaced from each other on the extension 12*a*, and located at respective positions near the lateral ends of the extension 12*a*. The first supports 15 are connected at the free ends thereof with each other through a bar 17. The bar 17 is provided on the top surface thereof with projections 16 at respective positions corresponding to the first supports 15. The projections 16 are adapted to be engaged in a snap-fit manner with a recess 10*c* formed near the front edge on the upper area of the housing wall defining the receptacle 10*a* when the covering element 12 is in the closed position (see FIG. 2D).

Advantageously, the extension 12*a*, the resilient first supports 15, the projections 16 and the bar 17 are made of a resinous material, and are integrally molded with each other. Also, it is preferred that the covering element 12 and the extension 12*a* are made of a resinous material, and are integrally molded with each other. The resilient first supports 15, the projections 16 and the bar 17 constitute a resiliently engaging member of the present invention.

The locking structure of the first embodiment also further includes a second support 18 generally uprightly extending from the base plate 14. The second support 18 is shaped as a horizontal flat plate extending generally parallel to the axes of the pins 13, and is provided at the free end thereof with a pair of catches 18*a*. The catches 18*a* are spaced from each other on the second support 18, and located at respective positions where the catches 18*a* can be arranged close to the respective resilient first supports 15 when the locking structure is in a locked position shown in FIG. 2C. The second support 18 is adapted to be engaged with the bottom surface of the bar 17 to securely support the bar 17 when the locking structure is in the locked position.

Advantageously, the base plate 14, the second support 18 and the catches 18*a* are made of a resinous material, and are integrally molded with each other. The base plate 14, the second support 18 and the catches 18*a* constitute a supporting member of the present invention.

Figure 3A:
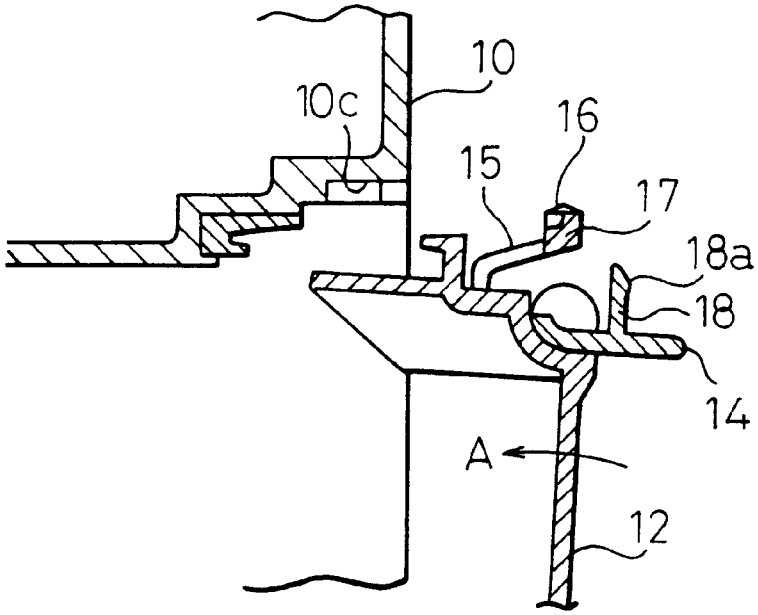
FIG. 3A is a sectional view of the locking structure in the unlocked position, and of a part of the covering element located in the opened position on the unit housing, as taken along the line C—C in FIG. 2B.
Figure 3B:
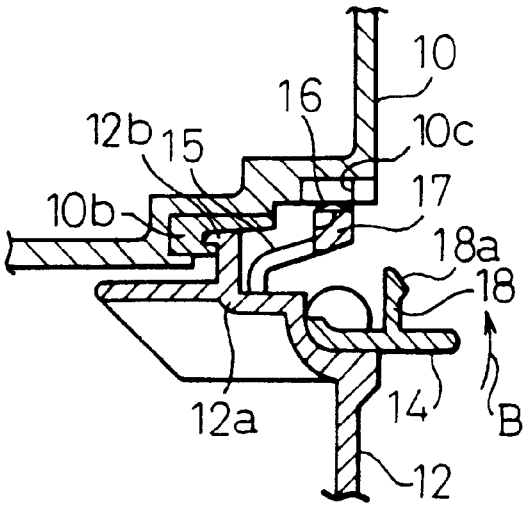
FIG. 3B is a sectional view of the locking structure in the unlocked position, and of a part of the covering element located in the closed position on the unit housing, as taken along the line C—C in FIG. 2B.
Figure 3C:
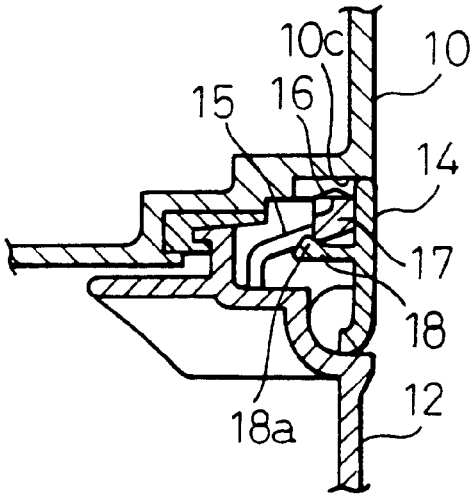
FIG. 3C is a sectional view of the locking structure in the locked position, and of a part of the covering element located in the closed position on the unit housing, as taken along the line C—C in FIG. 2B.

FIGS. 3A to 3C diagrammatically illustrate an operation of the locking structure of the first embodiment for locking the covering element 12 in the closed position. When the covering element 12 is in an opened position shown in FIG. 3A, the locking structure is in an unlocked position as shown therein, i.e., the base plate 14 falls and extends frontward on the covering element 12. Then, the covering element 12 is pivoted in a counterclockwise direction shown by an arrow A, and is finally located in the closed position shown in FIG. 3B for closing the opening of the receptacle 10*a* (FIG. 1). In the closed position of the covering element 12, the edge 12*b* of the extension 12*a* is fully engaged with the shoulder 10*b* formed on the housing 10.

Also, in the closed position, the projections 16 formed on the bar 17 supported on the resilient first supports 15 are engaged in a snap-fit manner into the recess 10*c* provided on the housing 10. While maintaining the closed position of the covering element 12, the base plate 14 is pivoted in a counterclockwise direction shown by an arrow B, and is finally located in the locked position shown in FIG. 3C. In the locked position of the locking structure or base plate 14, the second support 18 is engaged, particularly on the catches 18*a* thereof, with the bottom surface of the bar 17. Thereby, the bar 17 carrying the projections 16 is securely supported by the second support 18, and thus the projections 16 are kept in engagement with the recess 10*c*.

Consequently, the covering element 12 is securely locked on the housing 10 at the closed position, by an interengagement between the bar 17 and the second support 18. This interengagement serves to assist or enhance the supporting function of the resilient first supports 15 to keep the projections 16 engaged with the recess 10*c*. Further, the base plate 14 is held in the locked position by the interengagement between the catches 18*a* of the second support 18 and the bar 17.

When the base plate 14 is pivoted in a clockwise direction from the locked position of FIG. 3C, the bar 17 is disengaged from the second support 18, and the resilient first supports 15 are permitted to be freely deformed. Therefore, the covering element 12 can be easily opened by pivoting the covering element 12 from the closed position in FIG. 3B. In other words, the locking structure of the first embodiment cannot be released until the base plate 14 is shifted from the locked position and the catches 18*a* of the second support 18 are forced to be disengaged from the bar 17.

In this manner, the locking structure of the first embodiment can improve the stability and reliability of the locking function of the locking structure, even when the covering element 12 and/or housing 10 is subjected to a significant vibration or shock. Also, the locking structure of the first embodiment can certainly lock the covering element 12 in the closed position by a relatively easy operation for simply pivoting the base plate 14. Further, the locking structure of the first embodiment can readily eliminate inadvertently opening the covering element 12. Moreover, the locking structure of the first embodiment can be constructed, of a relatively small number of parts, by integrally molding the mutually fixed sections.

Figure 4A:
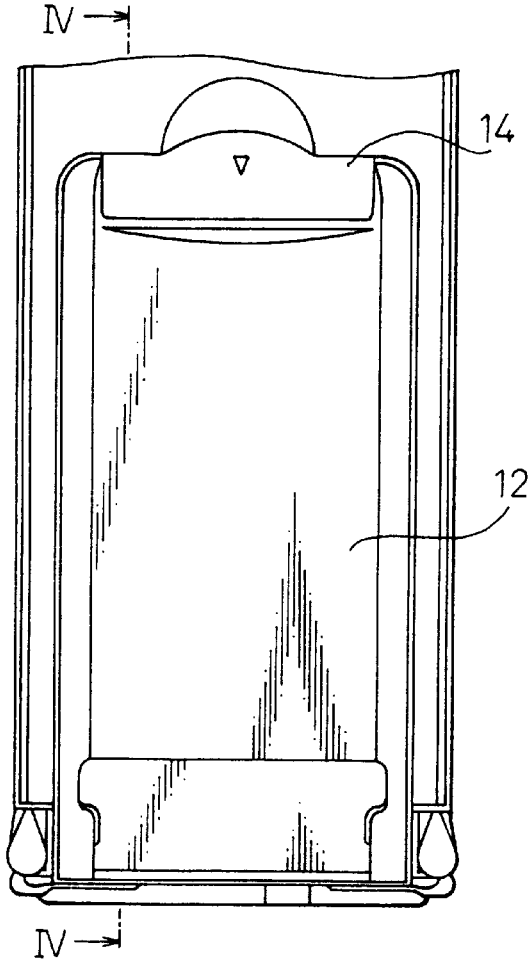
FIG. 4A is a front view of a covering element located in a closed position on a unit housing, showing a second embodiment of a locking structure, located in a locked position, according to the present invention.
Figure 4B:
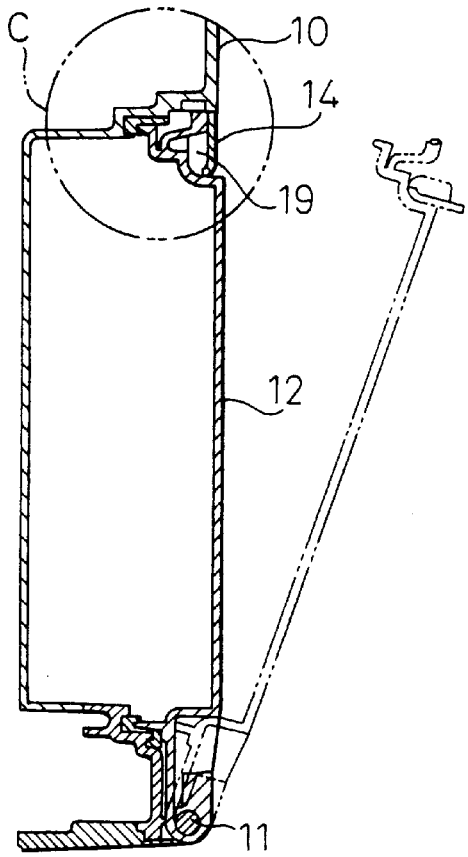
FIG. 4B is a sectional view taken along a line IV—IV in FIG. 4A, with a chain line showing the covering element in a opened position and the locking structure in an unlocked position.
Figure 4C:
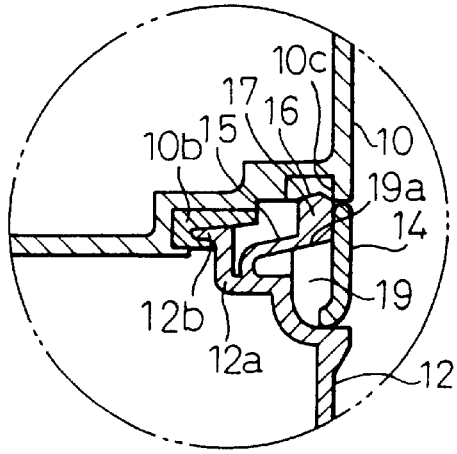
FIG. 4C is an enlarged partial sectional view of the locking structure in the locked position, and of a part of the covering element located in the closed position on the unit housing, as taken by a circle C in FIG. 2B.

FIGS. 4A to 4C show a second embodiment of a locking structure according to the present invention. The locking structure of the second embodiment is generally similar to the locking structure of the first embodiment, except for the construction of a second support 19 provided on the base plate 14. A detailed description of the features of the second embodiment identical to those of the first embodiment is not repeated.

As shown in FIGS. 4B and 4C, the locking structure of the second embodiment includes a second support 19 generally uprightly extending from the base plate 14. The second support 19 is shaped as a vertical rib extending generally orthogonally to the axes of the pins 13 (FIG. 2B), and is provided at the free end thereof with a slanted edge 19*a*. Any number and any location of the second support 19 may be adopted in the second embodiment. The second support 19 is adapted to be engaged on the slanted edge 19*a* thereof with the bottom surface of the bar 17 to securely support the bar 17 when the locking structure is in a locked position shown in FIG. 4C.

Advantageously, the base plate 14 and the second support 19 are made of a resinous material, and are integrally molded with each other. The base plate 14 and the second support 19 constitute a supporting member of the present invention.

In the closed position of the covering element 12 (FIG. 4C), the edge 12*b* of the extension 12*a* is fully engaged with the shoulder 10*b* formed on the housing 10. Also, in the closed position, the projections 16 formed on the bar 17 supported on the resilient first supports 15 are engaged in a snap-fit manner into the recess 10*c* provided on the housing 10. While maintaining the closed position of the covering element 12, the base plate 14 is located in the locked position, and thus the second support 19 is engaged on the slanted edge 19*a* thereof with the bottom surface of the bar 17. Thereby, the bar 17 carrying the projections 16 is securely supported by the second support 19, and thus the projections 16 are kept in engagement with the recess 10*c*.

Consequently, the covering element 12 is securely locked on the housing 10 at the closed position, by an interengagement between the bar 17 and the second support 19. In the second embodiment, this interengagement serves to assist or enhance the supporting function of the resilient first supports 15 more effectively than that in the first embodiment, because of the vertical-rib configuration of the second support 19. Further, the base plate 14 is held in the locked position by the interengagement between the slanted edge 19*a* of the second support 19 and the bar 17.

When the base plate 14 is pivoted in a clockwise direction from the locked position of FIG. 4C, the bar 17 is disengaged from the second support 19, and the resilient first supports 15 are permitted to be freely deformed. Therefore, the covering element 12 can be easily opened by pivoting the covering element 12 from the closed position in FIG. 4B. In other words, the locking structure of the second embodiment also cannot be released until the base plate 14 is shifted from the locked position and the slanted edge 19*a* of the second support 19 is forced to be disengaged from the bar 17.

In this manner, the locking structure of the second embodiment can improve the stability and reliability of the locking function of the locking structure, even when the covering element 12 and/or housing 10 is subjected to a significant vibration or shock. Also, the locking structure of the second embodiment can certainly lock the covering element 12 in the closed position by a relatively easy operation for simply pivoting the base plate 14. Further, the locking structure of the second embodiment can readily eliminate an inadvertently opened state of the covering element 12. Moreover, the locking structure of the second embodiment can be constructed of a relatively small number of parts by integrally molding the mutually fixed sections.

The above-mentioned first and second embodiments of the locking structure may be modified in various ways to further improve the stability and reliability of the locking function thereof, or to further facilitate the locking operation thereof while eliminating an inadvertently opened or half-opened state of the covering element.

Figure 5:
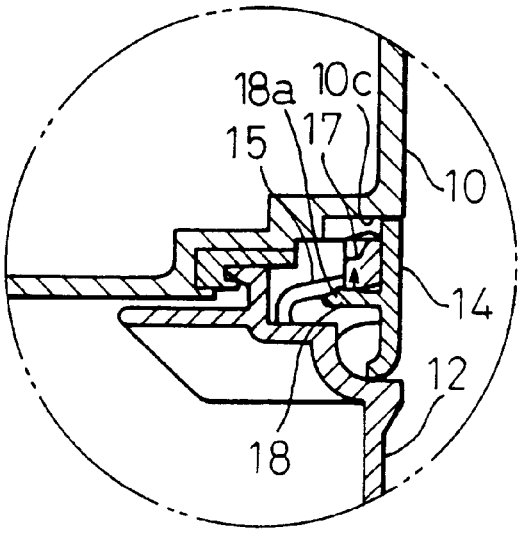
FIG. 5 is a sectional view similar to FIG. 2C, showing a modification of the locking structure of the first embodiment.

As shown in FIG. 5, the locking structure of the first embodiment may be modified in such a manner that the second support 18 can force the bar 17 into the recess 10*c* (as shown by an arrow in FIG. 5) against the resilience of the first supports 15 when the locking structure is in the locked position. This modification may be embodied by a suitable selection of the positional or dimensional relationship between the second support 18 and the bar 17.

According to this modification, the base plate 14 is firmly held in the locked position by the interengagement between the catches 18*a* of the second support 18 and the bar 17 due to the resilience of the first supports 15. Therefore, the projections 16 forced into engagement with the recess 10*c* are not readily disengaged from the recess 10*c* until the locking structure is intentionally displaced from the locked position, i.e., the base plate 14 is forced to be pivoted in a clockwise direction from the locked position of FIG. 5. Consequently, the locking structure of this modification can further effectively improve the stability and reliability of the locking function thereof, even when the covering element 12 and/or housing 10 is subjected to a significant vibration or shock.

Figure 6:
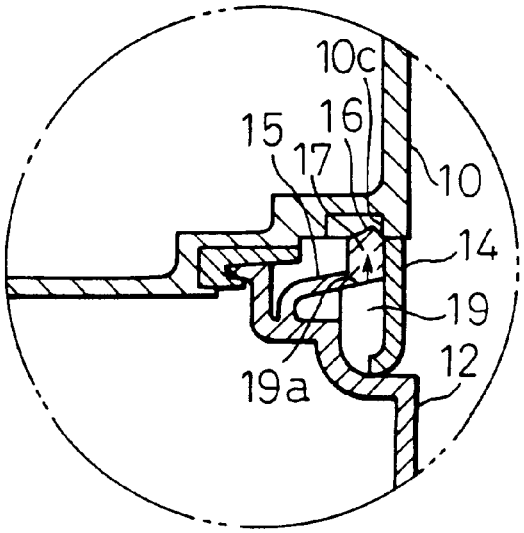
FIG. 6 is a sectional view similar to FIG. 4C, showing a modification of the locking structure of the second embodiment.

As shown in FIG. 6, the locking structure of the second embodiment may also be modified in such a manner that the second support 19 can force the bar 17 into the recess 10*c* (as shown by an arrow in FIG. 6) against the resilience of the first supports 15 when the locking structure is in the locked position. This modification may be embodied by a suitable selection of the positional or dimensional relationship between the second support 19 and the bar 17.

According to this modification, the base plate 14 is firmly held in the locked position by the interengagement between the slanted edge 19*a* of the second support 19 and the bar 17 due to the resilience of the first supports 15. Therefore, the projections 16 forced into engagement with the recess 10*c* are not readily disengaged from the recess 10*c* until the locking structure is intentionally displaced from the locked position, i.e., the base plate 14 is forced to be pivoted in a clockwise direction from the locked position of FIG. 6. Consequently, the locking structure of this modification can further effectively improve the stability and reliability of the locking function thereof, even when the covering element 12 and/or housing 10 is subjected to a significant vibration or shock.

Figure 7A:
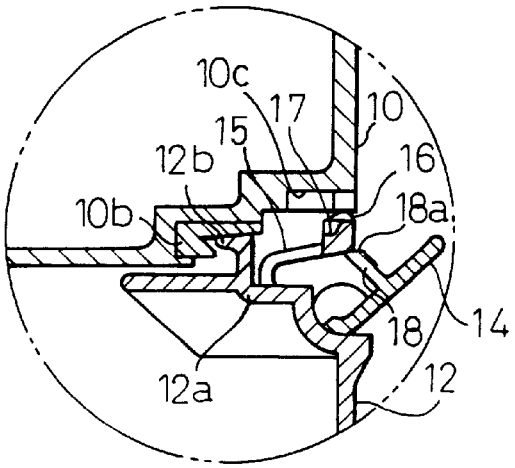
FIG. 7A is a sectional view of another modification of the locking structure of the first embodiment in a pre-locked position, and of a part of the covering element located in a half-closed position on the unit housing, as taken along the line C—C in FIG. 2B.
Figure 7B:
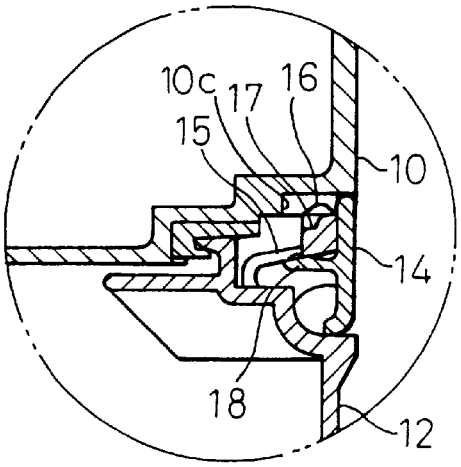
FIG. 7B is a sectional view similar to FIG. 2C, showing another modification of the locking structure of the first embodiment.

Referring to FIGS. 7A and 7B, the locking structure of the first embodiment may provide an additional advantageous effect by a positional or dimensional modification thereof, such as in the modification shown in FIG. 5. FIG. 7A shows a half-closed state of the covering element 12, wherein the edge 12*b* of the extension 12*a* is not fully engaged with the shoulder 10*b* formed on the housing 10, and the bar 17 is engaged at the projections 16 thereof with an edge surface, defining the opening of the receptacle 10*a* (FIG. 1B), of the housing 10 adjacent to the recess 10*c*. Also, in the half-closed state, the locking structure of the first embodiment is in the unlocked position.

In this situation, the locking structure of the first embodiment may be positionally or dimensionally modified in such a manner that, in the half-closed state of the covering element 12, the catches 18*a* of the second support 18 are abutted onto the bottom surface of the bar 17 to urge the bar 17 to be fitted or engaged within the recess 10*c*, by pivoting the base plate 14 toward the locked position. According to this modification, when the base plate 14 is forced into the locked position in the half-closed state of the covering element 12, the projections 16 of the bar 17 are fully engaged within the recess 10*c*, and simultaneously, the covering element 12 is completely located in the closed position as shown in FIG. 7B.

As can be understood from the above, the locking structure of the first embodiment cannot be shifted into the locked position when the covering element 12 is in the half-closed state. Therefore, an operator can readily confirm the half-closed state of the covering element 12. Furthermore, the locking structure modified as mentioned above can readily eliminate the half-closed state of the covering element 12 by forcing the locking structure to be fully shifted into the locked position.

Figure 8A:
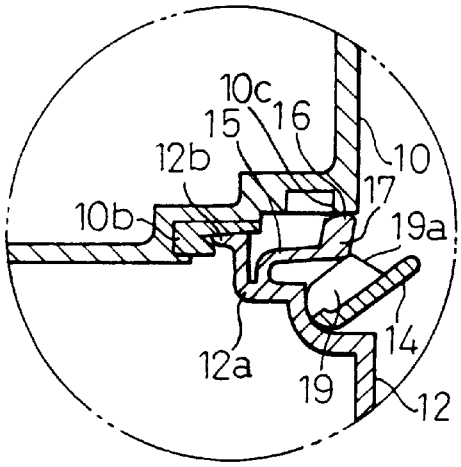
FIG. 8A is a sectional view of another modification of the locking structure of the second embodiment in a pre-locked position, and of a part of the covering element located in a half-closed position on the unit housing, as taken along the line IV—IV in FIG. 4A.
Figure 8B:
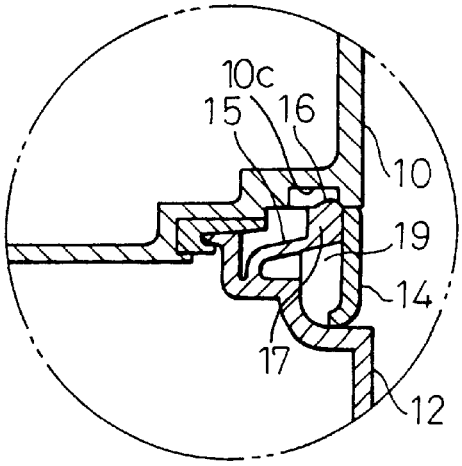
FIG. 8B is a sectional view, similar to FIG. 4C, showing another modification of the locking structure of the second embodiment.

Referring to FIGS. 8A and 8B, the locking structure of the second embodiment may also provide an additional advantageous effect by a positional or dimensional modification thereof, such as in the modification shown in FIG. 6. FIG. 8A shows a half-closed state of the covering element 12, similar to the half-closed state of FIG. 7A, and the locking structure of the second embodiment in the unlocked position.

In this situation, the locking structure of the second embodiment may be positionally or dimensionally modified in such a manner that, in the half-closed state of the covering element 12, the slanted edge 19*a* of the second support 19 is abutted onto the bottom surface of the bar 17 to urge the bar 17 to be fitted or engaged within the recess 10*c*, by pivoting the base plate 14 toward the locked position.

According to this modification, when the base plate 14 is forced into the locked position in the half-closed state of the covering element 12, the projections 16 of the bar 17 are fully engaged within the recess 10*c*, and simultaneously, the covering element 12 is completely located in the closed position as shown in FIG. 8B. The locking structure modified as mentioned above also can readily eliminate the half-closed state of the covering element 12 by forcing the locking structure to be fully shifted into the locked position.

Figure 9:
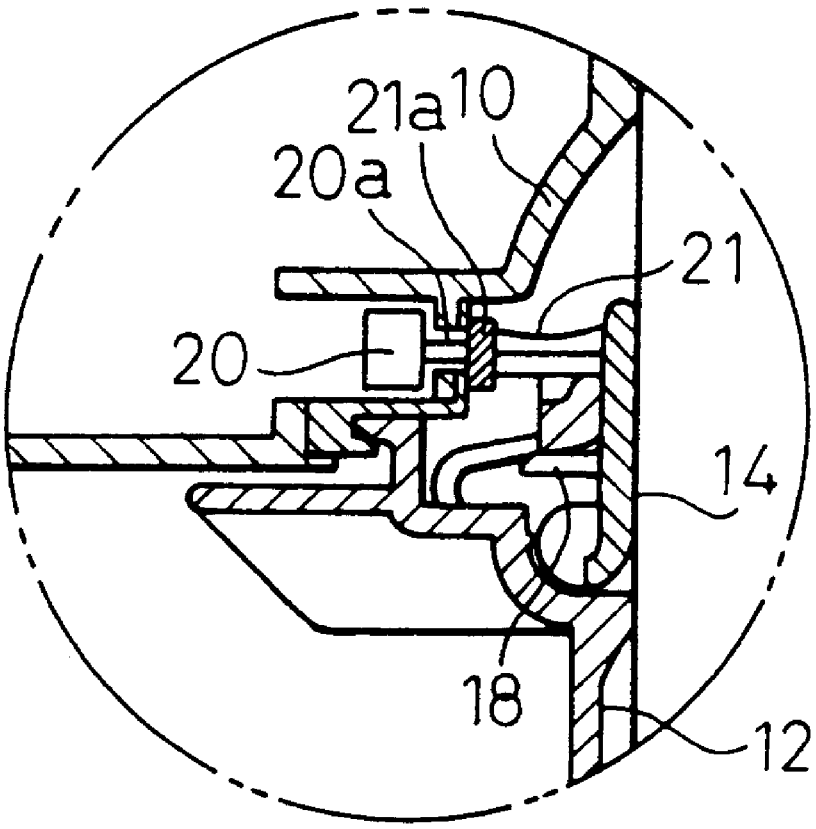
FIG. 9 is a sectional view showing an optional feature of the locking structure of the first embodiment in the locked position, and of a part of the covering element located in the closed position on the unit housing, as taken along a line IX—IX in FIG. 1.

FIG. 9 shows an optional feature of the locking structure of the first embodiment, as follows. The locking structure includes a switch 20 for detecting whether the covering element 12 is fully locked in the closed position. The switch 20 is fixedly mounted on the housing 10 at the upper area of a housing wall defining the receptacle 10*a* (FIG. 1B), and includes an actuating pin 20*a* projecting frontward from the housing wall. The base plate 14 is provided with a pushing part 21 which may integrally and uprightly project from the base plate 14 in the same direction as the second support 18.

When the locking structure or base plate 14 is shifted into the locked position, the pushing part 21 pushes the actuating pin 20*a* to turn the switch 20 on (see FIG. 9). When the locking structure or base plate 14 is shifted into the unlocked position, the pushing part 21 is disengaged from the actuating pin 20*a* to turn the switch 20 off.

According to this feature, it is possible to use the switch 20 as a supplementary electric power switch of the portable electrical unit, such as a notebook-size personal computer, to turn off a power supply when the locking structure or base plate 14 is shifted into the unlocked position. In this manner, in a certain case where the covering element 12 is inadvertently opened due to the locking structure shifted into the unlocked position, and thereby a battery accommodated in the receptacle 10*a* unexpectedly disconnects, the power switch has already been turned off, so that it is possible to prevent the disappearance of stored data or to improve the security of the internal circuitry of the electrical unit.

Of course, the above optional feature may be applied to the second embodiment or to some illustrated modifications of the locking structure.

While the invention has been particularly shown and described with reference to preferred embodiments thereof, it will be understood by those skilled in the art that various changes and modifications may be made without departing from the spirit and scope of the invention. For example, both the engaging member and the supporting member may be provided on the second portion of the housing, instead of on the covering element or the first portion of the housing. Alternatively, one of the engaging and supporting members may be provided on the first portion, and the other provided on the second portion. In any event, the scope of the invention is to be determined solely by the appended claims.

What is claimed is:

1. In combination with a unit housing and a covering element pivotably connected through a shaft to said unit housing, a locking structure for releasably locking said covering element in a closed position on said unit housing, comprising:

a resiliently engaging member integrally formed on said covering element adjacent to a distal end region of said covering element away from said shaft for a releasable engagement with said unit housing; and a supporting member pivotably connected through a second shaft to said covering element adjacent to said distal end region, said supporting member being engaged with said resiliently engaging member to stably support said resiliently engaging member when said locking structure is in a locked position, and being disengaged from said resiliently engaging member when said locking structure is in an unlocked position.

2. The combination as defined in claim 1, wherein said resiliently engaging member includes at least one resilient first support projecting from said covering element and at least one projection formed on a free end of said resilient first support to be releasably engaged with said unit housing.

3. The combination as defined in claim 2, wherein said resiliently engaging member includes a pair of resilient first supports projecting from said covering element, a bar connecting respective free ends of said resilient first supports with each other and a pair of projections formed on said bar to be releasably engaged with said unit housing.

4. The combination as defined in claim 1, wherein said supporting member includes a base plate pivotably connected to said covering element and a second support extending from said base plate to be releasably engaged with said resiliently engaging member.

5. The combination as defined in claim 4, wherein said second support is formed as a flat plate extending from said base plate, and at least one catch is provided at a free end of said flat plate, said base plate being held in said locked position by an interengagement between said catch and said resiliently engaging member.

6. The combination as defined in claim 4, wherein said second support is formed as at least one rib extending from said base plate, and a slanted edge is provided at a free end of said rib, said base plate being held in said locked position by an interengagement between said slanted edge and said resiliently engaging member.

7. The combination as defined in claim 1, wherein said supporting member is arranged to force said resiliently engaging member into a fixed engagement with said unit housing.

8. The combination as defined in claim 1, further comprising a switching mechanism for detecting said closed position of said covering element, said switching mechanism being actuated by said supporting member when said supporting member is pivoted on said covering element.

9. A device comprising:

a housing including a first portion and a second portion, said first portion being movable relative to said second portion;

an engaging member integrally formed on the first portion for releasable engagement with said second portion; and a supporting member pivotably provided on said first portion, said supporting member being releasably engaged with said engaging member to stably support said engaging member in engagement with said second portion, to lock said first portion to said second portion.

10. A device as defined in claim 9, wherein said second portion includes a recess for said releasable engagement with said engaging member.

11. A device as defined in claim 10, wherein said supporting member is arranged to force said engaging member into a fixed engagement with said recess.

12. In combination with a unit housing and a covering element, a locking structure for releasably locking said covering element in a closed position on said unit housing, comprising:

a resiliently engaging member integrally formed on said covering element for a releasable engagement with said unit housing, said resiliently engaging member including a pair of resilient first supports projecting from said covering element, a bar connecting respective free ends of said resilient first supports with each other, and a pair of projections formed on said bar to be releasably engaged with said unit housing; and a supporting member pivotably connected to said covering element, said supporting member being engaged with said resiliently engaging member to stably support said resiliently engaging member when said locking structure is in a locked position, and being disengaged from said resiliently engaging member when said locking structure is in an unlocked position.

13. In combination with a unit housing and a covering element, a locking structure for releasably locking said covering element in a closed position on said unit housing, comprising:

a resiliently engaging member integrally formed on said covering element for a releasable engagement with said unit housing; and a supporting member pivotably connected to said covering element, said supporting member being engaged with said resiliently engaging member to stably support said resiliently engaging member when said locking structure is in a locked position, and being disengaged from said resiliently engaging member when said locking structure is in an unlocked position, wherein said supporting member includes a base plate pivotably connected to said covering element and a second support extending from said base plate to be releasably engaged with said resiliently engaging member;

said second support being formed as a flat plate extending from said base plate, and at least one catch is provided at a free end of said flat plate, said base plate being held in said locked position by an interengagement between said catch and said resiliently engaging member.

14. In combination with a unit housing and a covering element, a locking structure for releasably locking said covering element in a closed position on said unit housing, comprising:

a resiliently engaging member integrally formed on said covering element for a releasable engagement with said unit housing; and a supporting member pivotably connected to said covering element, said supporting member being engaged with said resiliently engaging member to stably support said resiliently engaging member when said locking structure is in a locked position, and being disengaged from said resiliently engaging member when said locking structure is in an unlocked position, wherein said supporting member includes a base plate pivotably connected to said covering element and a second support extending from said base plate to be releasably engaged with said resiliently engaging member; said second support being formed as at least one rib extending from said base plate, and a slanted edge is provided at a free end of said rib, said base plate being held in said locked position by an interengagement between said slanted edge and said resiliently engaging member.

* * * * *